US007148863B2

(12) United States Patent
Lee et al.

(10) Patent No.: US 7,148,863 B2
(45) Date of Patent: Dec. 12, 2006

(54) METHOD AND APPARATUS FOR DRIVING PLASMA DISPLAY PANEL

(75) Inventors: Eun Cheol Lee, Kumi-shi (KR); Seong Ho Kang, Daegu (KR)

(73) Assignee: LG Electronics Inc., Seoul (KR)

( * ) Notice: Subject to any disclaimer, the term of this patent is extended or adjusted under 35 U.S.C. 154(b) by 290 days.

(21) Appl. No.: 10/329,503

(22) Filed: Dec. 27, 2002

(65) Prior Publication Data

US 2003/0122740 A1 Jul. 3, 2003

(30) Foreign Application Priority Data

Dec. 28, 2001 (KR) ..... 10-2001-0086963

(51) Int. Cl.
*G09G 3/28* (2006.01)

(52) U.S. Cl. ..... 345/60; 345/63; 345/66; 345/68; 313/484; 313/585; 315/169.1; 315/169.4

(58) Field of Classification Search ..... 345/60, 345/62, 63, 66, 68, 78; 313/484, 585; 315/169.1, 315/169.4

See application file for complete search history.

(56) References Cited

U.S. PATENT DOCUMENTS

| | | | | |
|---|---|---|---|---|
| 5,724,054 | A * | 3/1998 | Shinoda | 345/60 |
| 5,852,347 | A | 12/1998 | Marcotte | |
| 6,097,357 | A * | 8/2000 | Shinoda et al. | 345/63 |
| 6,294,875 | B1 * | 9/2001 | Kurata et al. | 315/169.1 |
| 6,320,561 | B1 * | 11/2001 | Arimoto et al. | 345/60 |
| 2001/0017605 | A1 * | 8/2001 | Hashimoto et al. | 345/60 |
| 2003/0006945 | A1 * | 1/2003 | Lim et al. | 345/67 |
| 2003/0189534 | A1 * | 10/2003 | Myoung et al. | 345/67 |
| 2004/0027316 | A1 * | 2/2004 | Kang et al. | 345/60 |
| 2004/0145542 | A1 * | 7/2004 | Kim | 345/60 |

* cited by examiner

*Primary Examiner*—Bipin Shalwala
*Assistant Examiner*—Vincent E. Kovalick
(74) *Attorney, Agent, or Firm*—Fleshner & Kim, LLP

(57) ABSTRACT

It is disclosed that there are a method and an apparatus of driving a plasma display panel that are adaptive for reducing an initialization period.

A driving apparatus and a method of a plasma display panel according to the present invention include a driving circuit applying to the plasma display panel a ramp-up waveform rising from a first bias voltage and a ramp-down waveform falling down from a second bias voltage.

18 Claims, 7 Drawing Sheets

METHOD AND APPARATUS FOR DRIVING PLASMA DISPLAY PANEL

BACKGROUND OF THE INVENTION

1. Field of the Invention

This invention relates to a plasma display panel, and more particularly to a method and an apparatus of driving a plasma display panel that are adaptive for reducing an initialization period.

2. Description of the Related Art

Generally, a plasma display panel (PDP) allows an ultraviolet ray generated when an inactive gas such as He+Xe, Ne+Xe or He+Xe+Ne, etc. is discharged to radiate a phosphorus, to thereby display a picture. Such a PDP is easy to be made into a thin-film and large-dimension type. Moreover, the PDP provides a very improved picture quality owing to a recent technical development.

Referring to FIG. 1, a discharge cell of a three electrode AC discharge PDP includes a pair of sustain electrode having a scan electrode 30Y and a common sustain electrode 30Z formed on an upper substrate 10, and an address electrode 20X formed on a lower substrate 18 and crossing the pair of sustain electrodes. The scan electrode 30Y and the common sustain electrode 30Z have structures of transparent electrodes 12Y and 12Z and metal bus electrodes 13Y and 13Z being deposited respectively. There are an upper dielectric layer 14 and a Magnesium Oxide MgO passivation film 16 formed on the upper substrate 10 where the scan electrode 30Y and the common sustain electrode 30Z are formed side by side. On a lower substrate where the address electrode 20X is formed, there are a lower dielectric layer 22 and barrier ribs 24 formed and there is a phosphorus layer 26 spread on the surface of the lower dielectric layer 22 and the barrier ribs 24. There is inactive mixture gas such as He+Xe, Ne+Xe or He+Ne+Xe interposed into a discharge space provided between the upper/lower substrates 10 and 18 and the barrier ribs 24.

The PDP is driven with time-division by dividing one frame into various sub-fields that have different light-emission frequencies, so as to realize gray levels of a picture. Each sub-field is again divided into an initialization period for initializing the full screen, an address period for selecting scan lines and selecting cells from the selected scan lines, and a sustain period for realizing gray levels depending on a discharge frequency. For instance, when it is intended to display a picture of 256 gray levels, a frame period equal to 1/60 second (i.e. 16.67 msec), as in FIG. 2, is divided into 8 sub-fields SF1 to SF8. Each of the 8 sub-fields SF1 to SF8 is divided into the initialization period, the address period and the sustain period, as described above. The initialization period and the address period of each sub-field are equal for each sub-field, whereas the sustain period is increased at a ratio of $2^n$ (wherein n=0, 1, 2, 3, 4, 5, 6 and 7) at each sub-field.

FIG. 3 show sa driving waveform of a PDP which are applied to two sub-fields.

In FIG. 3, Y represents a scan electrode, Z represents a common sustain electrode, and X represents an address electrode.

Referring to FIG. 3, the PDP is driven by dividing a frame into the initialization period for initializing a full screen, an address period for selecting cells and a sustain period for sustaining the discharge of the selected cells.

In the initialization period, there is a ramp-up waveform applied to all the scan electrodes Y simultaneously during a setup period SU. The ramp-up waveform causes a weak discharge within the cells of the full screen for wall charges to be generated within the cells. During a set down period SD, there is a ramp-down waveform applied to the scan electrodes Y simultaneously after the ramp-up waveform being applied, herein the ramp-down waveform falls down from a positive voltage lower than a peak voltage of the ramp-up waveform. The ramp-down waveform, as in FIG. 4, causes a weak erasure discharge within the cells, thereby uniformly leaving wall charges required for the address discharge within the cells of the full screen.

In the address period, a negative scan pulse SCAN is sequentially applied to the scan electrodes Y and, at the same time, a positive data pulse DATA is applied to the address electrodes X. While a voltage difference between the scan pulse SCAN and the data pulse DATA is added to the wall charges generated in the initialization period, an address discharge is generated within the cell supplied with the data pulse DATA. There are wall charges generated within the cells selected by the address discharge.

The common sustain electrode Z is supplied with a positive DC voltage Zdc during the set-down period and the address period.

During the sustain period, sustain pulses SUS are alternately applied to the scan electrodes Y and the common sustain electrodes Z. Whenever the sustain pulse SUS is applied, in the cell selected by the address discharge, wall voltages within the cell are added to the sustain pulse SUS to generate a sustain discharge in a surface discharge type between the scan electrode Y and the common sustain electrode Z. Lastly, after the completion of the sustain discharge, there is an erasure ramp waveform ERASE with a narrow pulse width applied to the common sustain electrode Z to make the wall charges within the cell eliminated.

By the way, the conventional PDP has a problem that the initialization period is excessively long because the gradient of the ramp waveforms RAMP-UP and RAMP-DOWN and the voltage variation range thereof are relatively big. Also, the conventional PDP has a problem that bias voltages of the ramp-up waveform and the ramp-down waveform fail to comply with address conditions. To describe in detail, for making the discharge property of the full screen uniform, if the gradients of the ramp waveforms RAMP-UP and RAMP-DOWN are set at a specified gradient and, as in FIG. 5, the bias voltage Vbias as a reference voltage at the point of time when the ramp-up waveform begins to be applied is the same as the bias voltage Vbias as a reference voltage at the point of time when the ramp-down waveform begins to be applied, the set-down period SD is lengthened to be as long as the setup period SU. In this way, if the ramp-down waveform begin to be applied at the same voltage as the bias voltage Vbias of the ramp-up waveform, the weak discharge is kept relatively so long that the wall charges within the cell can be excessively eliminated. In this case, there is no address discharge generated because there is not enough wall charges accumulated within the cell to cause the address discharge even when the address voltage is applied.

SUMMARY OF THE INVENTION

Accordingly, it is an object of the present invention to provide a method and an apparatus of driving a plasma display panel that are adaptive for reducing an initialization period.

In order to achieve these and other objects of the invention, a method of driving a plasma display panel according to an aspect of the present invention includes steps of applying to the plasma display panel a ramp-up waveform rising from a first bias voltage; and applying to the plasma display panel a ramp-down waveform falling down from a second bias voltage subsequently to the ramp-up waveform.

The second bias voltage is lower than the first bias voltage.

Herein, a voltage difference between the first bias voltage and the second bias voltage is about 30V or less.

Herein, a gradient of the ramp-down waveform is about 9V/μs or less.

A driving apparatus of a plasma display panel according to another aspect of the present invention includes a driving circuit applying to the plasma display panel a ramp-up waveform rising from a first bias voltage and a ramp-down waveform falling down from a second bias voltage.

Herein, the second bias voltage is lower than the first bias voltage.

Herein, a voltage difference between the first bias voltage and the second bias voltage is about 30V or less.

Herein, a gradient of the ramp-down waveform is about 9V/μs or less.

Herein, the driving circuit applies the ramp-up waveform and the ramp-down waveform to a scan electrode of the plasma display panel.

Herein, the driving circuit applies a scan voltage to the scan electrode, and then applies a sustain pulse to the scan electrode.

The driving apparatus further includes a data driving circuit for applying data to a data electrode of the plasma display panel; and a sustain driving circuit for applying the sustain pulse to a common sustain electrode of the plasma display panel.

BRIEF DESCRIPTION Or THE DRAWINGS

These and other objects of the invention will be apparent from the following detailed description of the embodiments of the present invention with reference to the accompanying drawings, in which.

Figure 1:
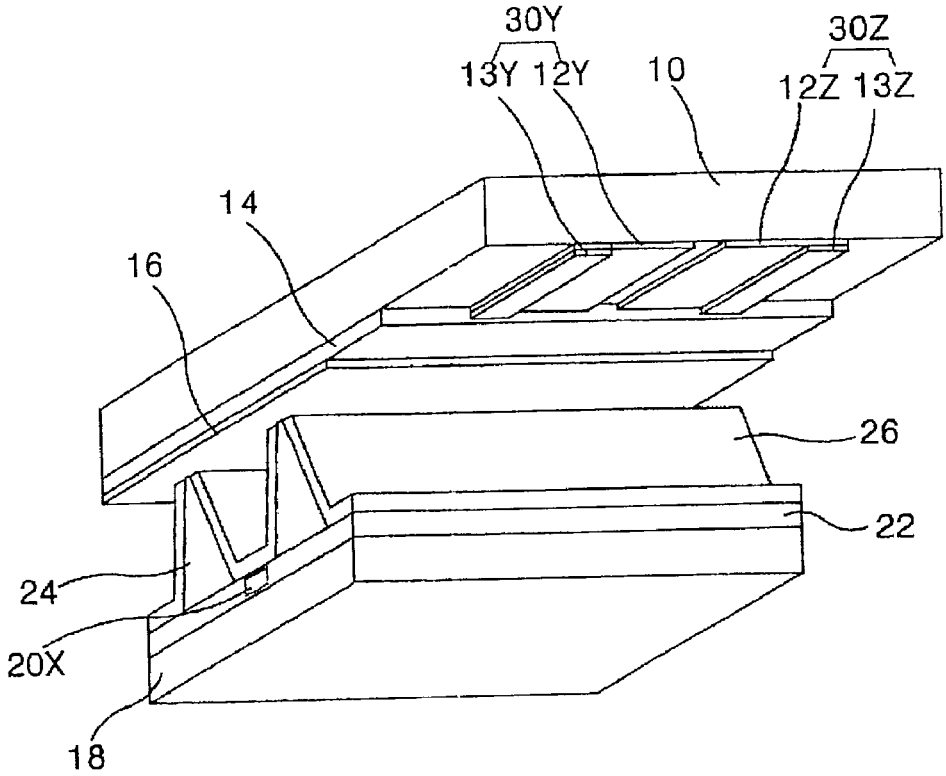
FIG. 1 RELATED ART
FIG. 1 is a perspective view representing a discharge cell structure of a conventional three electrode AC surface discharge PDP.
Figure 2:
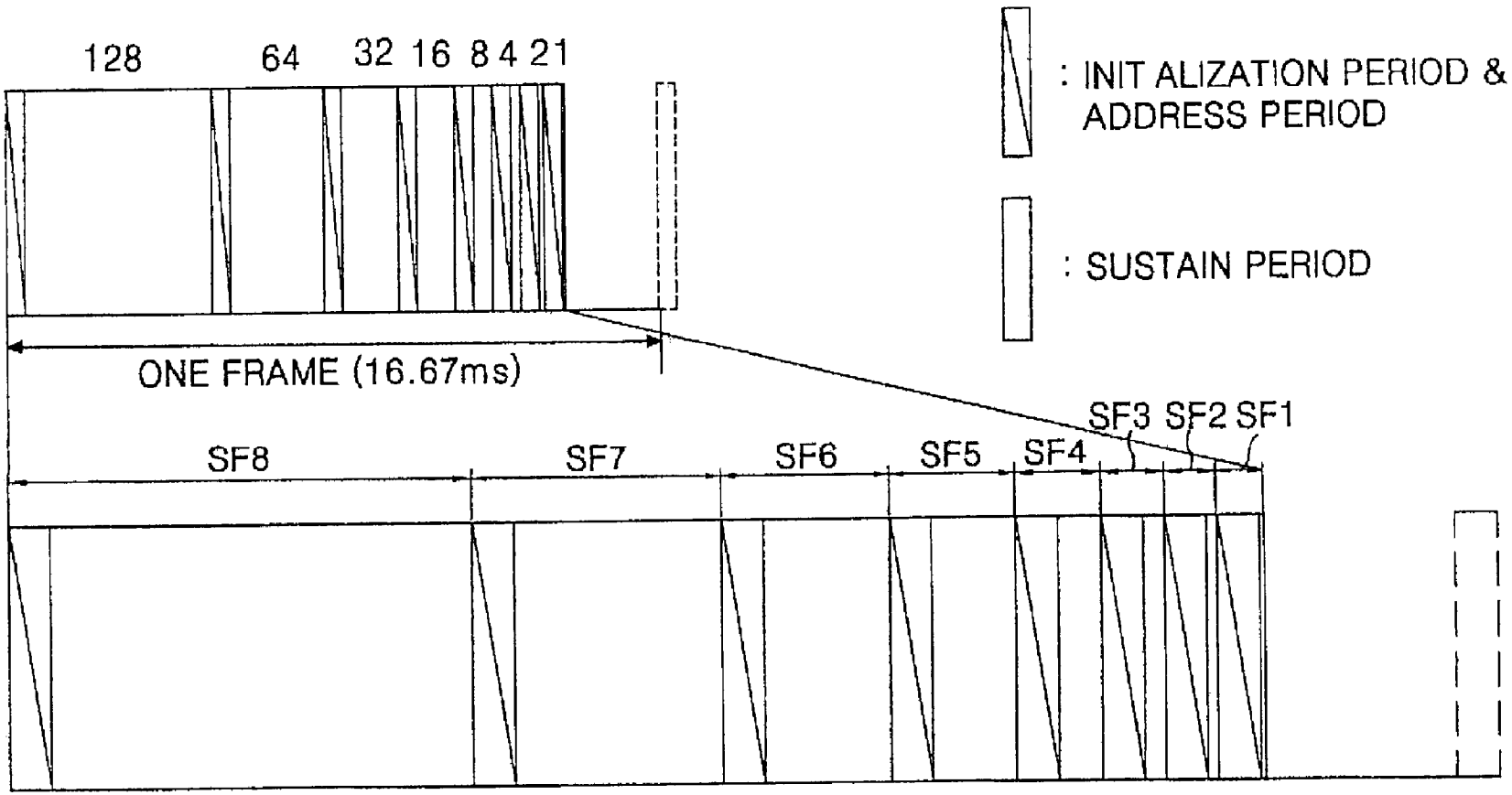
FIG.2 RELATED ART
FIG. 2 illustrates a frame configuration of an 8 bit default code for realizing 256 gray levels.
Figure 3:
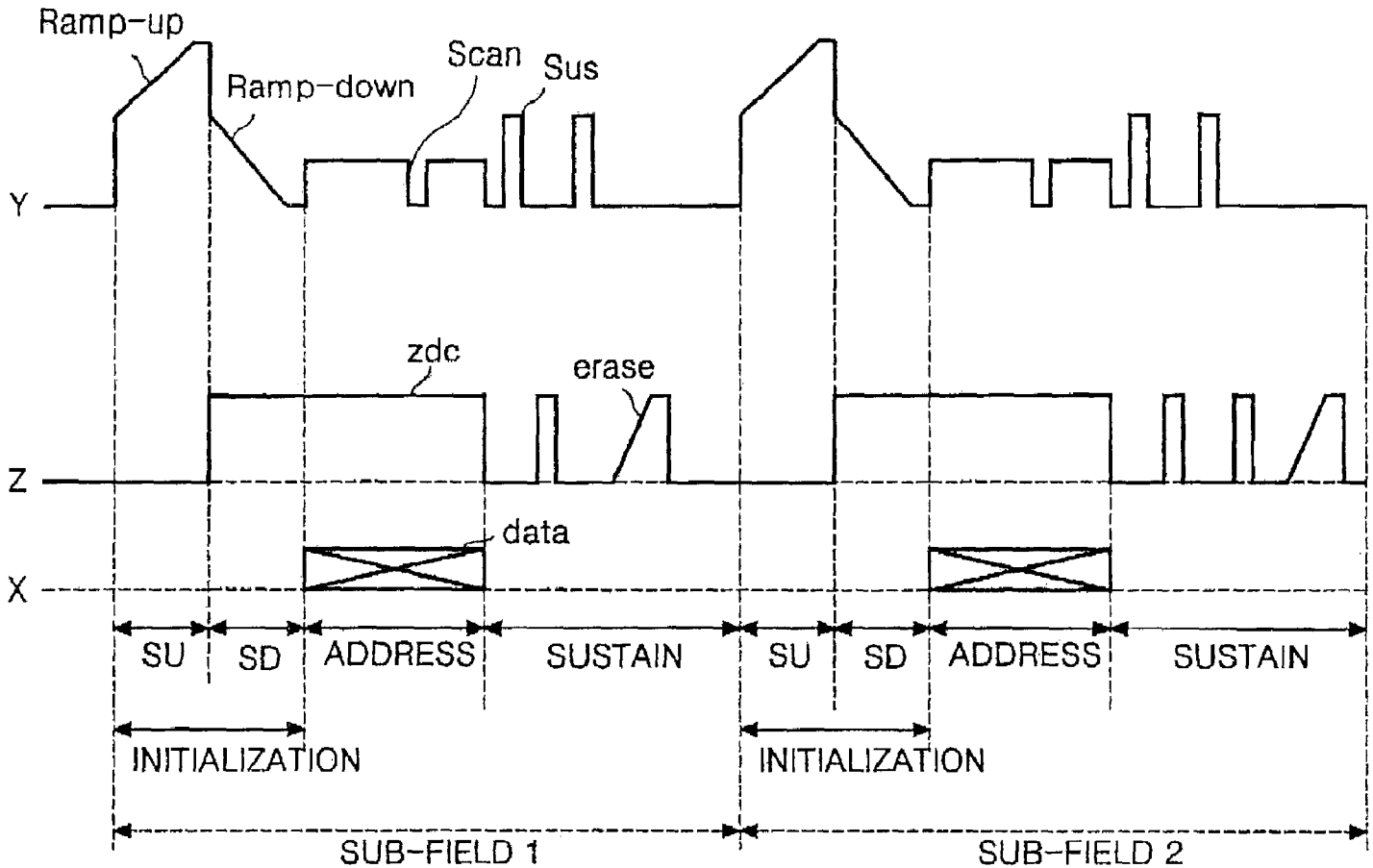
FIG. 3 RELATED ART
FIG. 3 illustrates a driving waveform for driving a conventional PDP.
Figure 4:
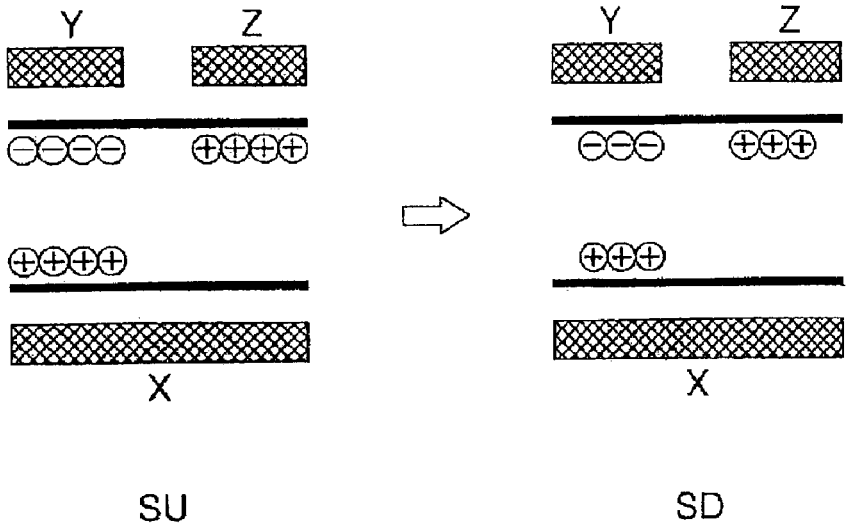
FIG. 4 RELATED ART
Figure 5:
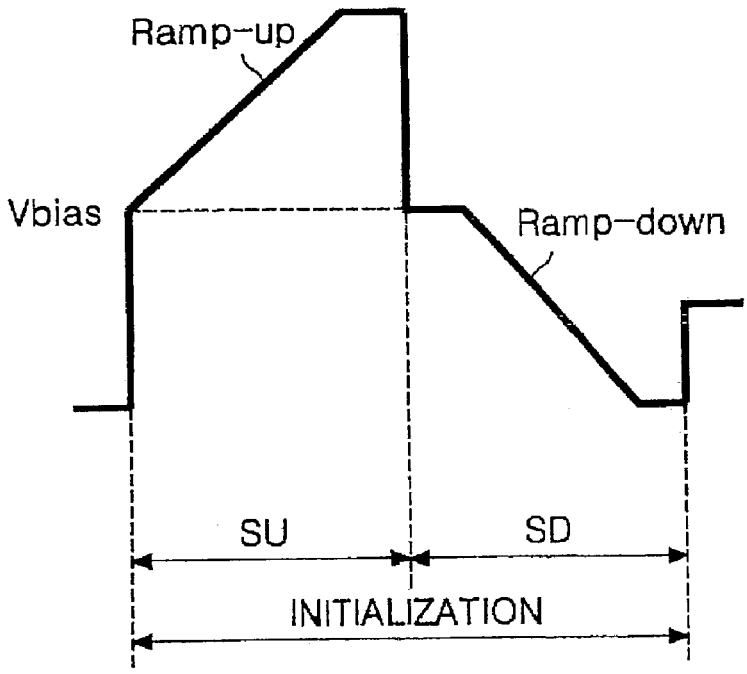
FIG. 5 RELATED ART
Figure 6:
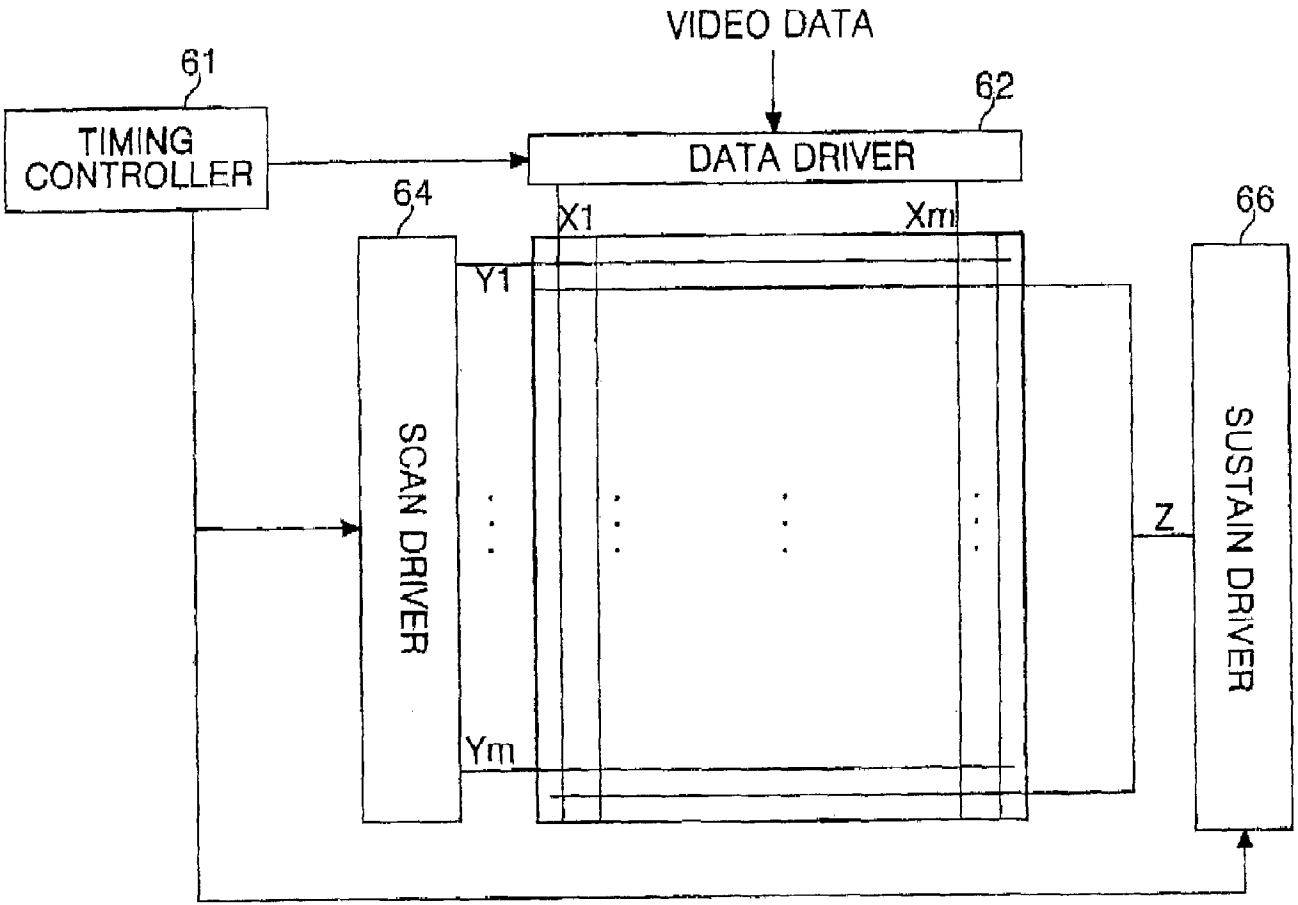
Figure 7:
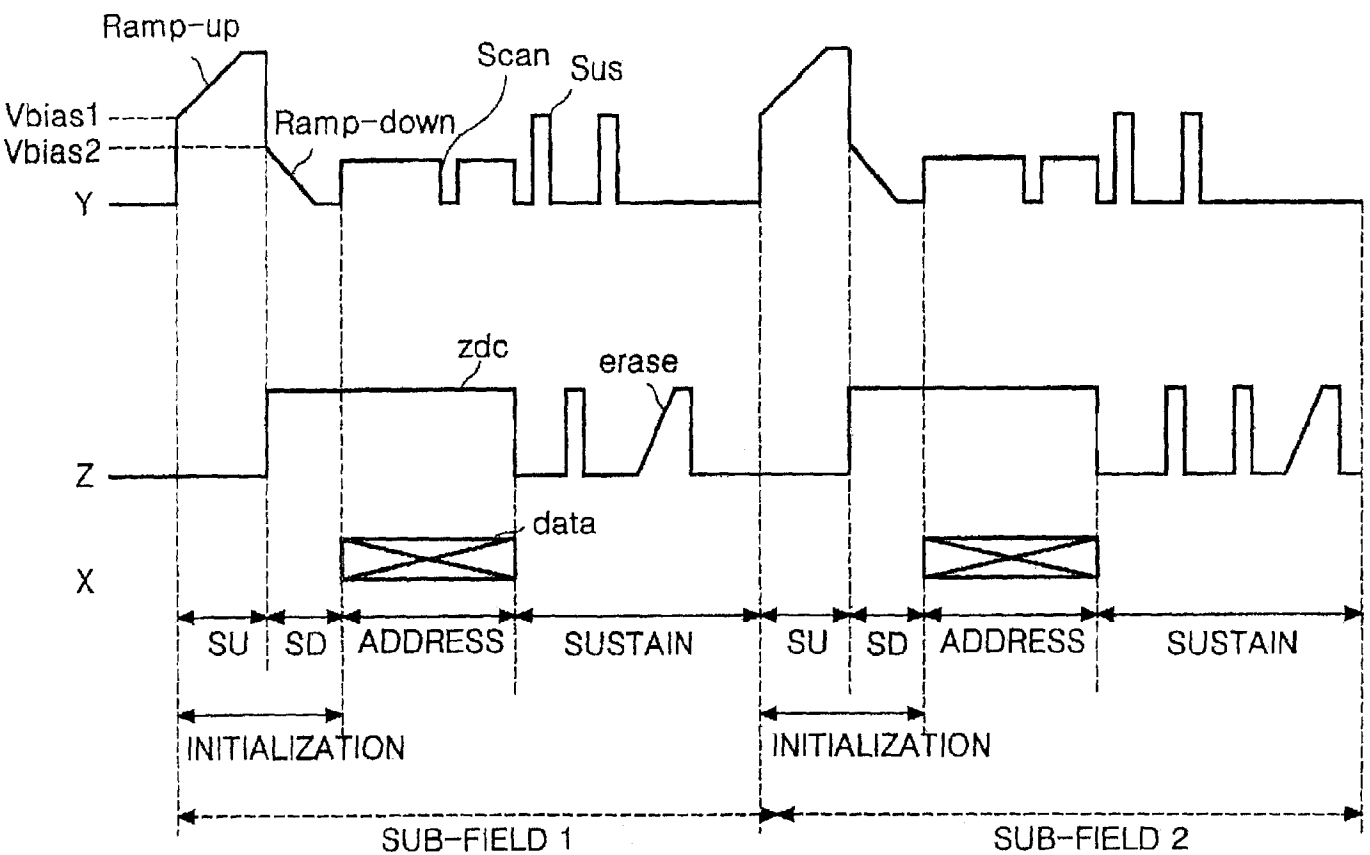
Figure 8:
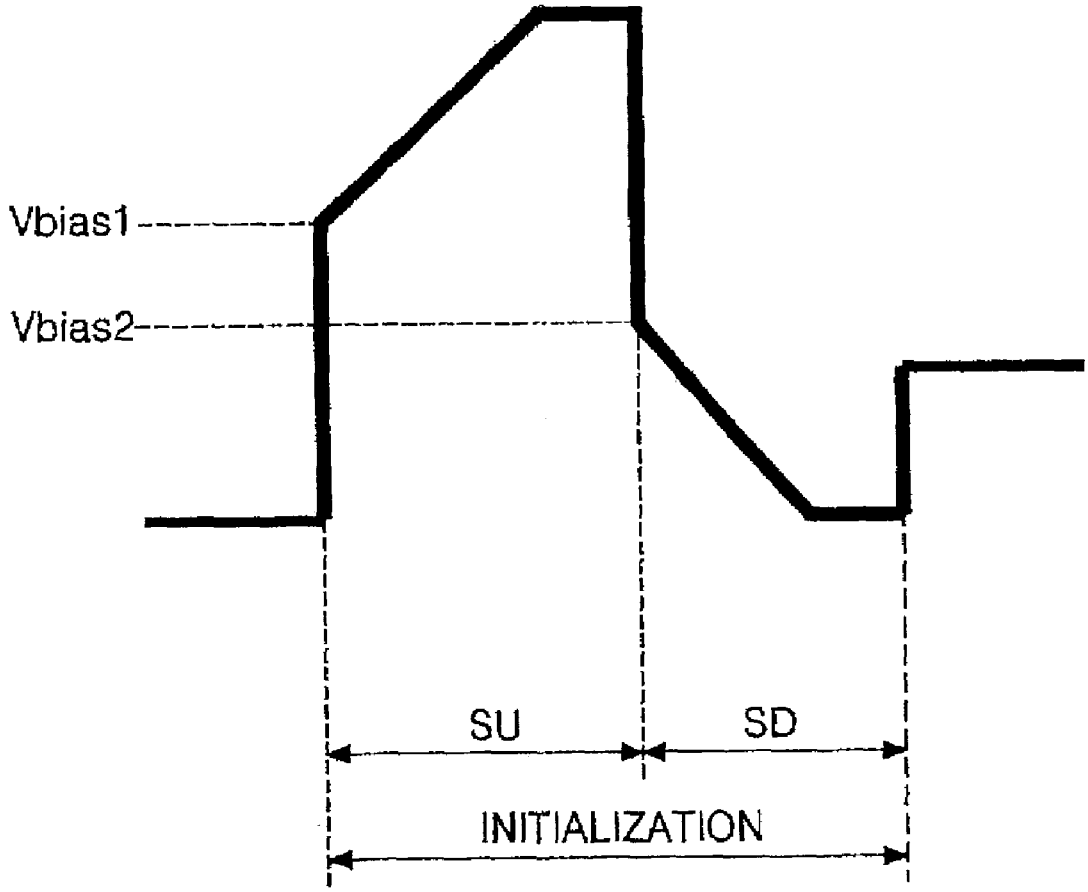

FIG. 4 a longitudinal section view of a PDP cell schematically representing wall charges accumulated within the cell in an initialization period;

FIG. 5 illustrates an enlarged waveform of an initialization waveform shown in FIG. 3;

FIG. 6 is a block diagram representing a driving apparatus of a PDP according to an embodiment of the present invention;

FIG. 7 illustrates a driving waveform to describe a driving method of a PDP according to an embodiment of the present invention; and FIG. 8 illustrates an enlarged waveform of an initialization waveform shown in FIG. 7.

DETAILED DESCRIPTION OF THE PREFERRED EMBODIMENT

Reference will now be made in detail to the preferred embodiments of the present invention, examples of which are illustrated in the accompanying drawings.

Referring to FIG. 6, a driving apparatus of a PDP according to the present invention includes a data driver 62 applying data to data lines X1 to Xm, a scan driver 64 applying to scan electrodes Y1 to Ym a ramp-up waveform and a ramp-down waveform that have different start voltage from each other, a sustain driver 66 applying a sustain pulse to the common sustain electrode Z, and a timing controller 61 controlling each of the drivers 62, 64 and 66.

The data driver 62 latches data by one line portion under the control of the timing controller 61 and applies them to the data lines X1 to Xm at the same time. Herein, after reverse gamma correction and error diffusion being applied to the data by a reverse gamma correction circuit and an error diffuser respectively, the data is mapped to each sub-field by a sub-field mapping circuit before the latch of the data.

The scan driver 64 applies the ramp-up waveform in the initialization period and the ramp-down waveform when the voltage is lower than the start voltage or the bias voltage of the ramp-up waveform. In this way, because the ramp-down waveform is applied at a start voltage lower than the start voltage of the ramp-up waveform, assuming that its gradient is the same as that in the prior art, a set-down period is reduced as much. The start voltage of the ramp-down waveform is lower than the start voltage of the ramp-up waveform. The start voltage of the ramp-down waveform can be adjusted to the voltage that the address condition of a panel is uniform. Also, the scan driver 64 sequentially applies to the scan electrodes Y1 to Ym scan pulses for selecting scan lines in an address period At the same time, it applies to the scan electrodes Y1 to Ym sustain pulses for generating a sustain discharge with respect to the cells selected during the address period.

The sustain driver 66, after applying a positive DC voltage to the common sustain electrode Z in a set-down period and the address period, alternately with the scan driver 64 applies the sustain pulse to the common sustain electrode Z during a sustain period.

The timing controller 61 receives vertical/horizontal synchronization signals, generates timing control signals necessary for each of the drivers 62, 64 and 66, and applies the timing control signal to each of the drivers 62, 64 and 66. Specifically, the timing controller 61 controls the switching timing of the scan driver 64 for the ramp-down waveform to be able to be applied at the voltage lower than the start voltage of the ramp-up waveform.

FIG. 7 represents a driving waveform of a POP according to an embodiment of the present invention, and FIG. 8 particularly represents a ramp waveform and the bias voltage thereof in an initialization period.

In FIG. 7, Y represents a scan electrode, Z represents a common sustain electrode, and X represents an address electrode.

Referring to FIGS. 7 and 8, a PDP according to the present invention is driven by dividing one frame into an initialization period initializing a full screen, an address period for selecting cells, and a sustain period for keeping the discharge of the selected cells.

In the initialization period, during a set-up period SU a ramp-up waveform is applied to all the scan electrodes Y simultaneously. Herein, the ramp-up waveform starts to rise from a first bias voltage Vbias1 to a peak voltage which is higher than a sustain voltage. The ramp-up waveform causes weak discharges within the cells of the full screen to accumulate negative wall charges in the scan electrode Y and positive wall charges in the common sustain electrode Z.

During a set-down period SD a ramp-down waveform is generated from a second positive bias voltage Vbias2 which is lower than the first bias voltage Vbias1 of the ramp-up waveform, and simultaneously applied to the scan electrodes Y. The set-down period SD becomes shortened as much as the second bias voltage Vbias2 is lowered when the gradient of the ramp-down waveform is the same as that in the prior art. The bias voltage Vbias2 of the ramp-down waveform can be adjusted in accordance with the address condition of an actual panel. Such a ramp-down waveform caused weak discharges within the cells of the full screen to uniformly keep the wall charges necessary for the address discharge within the cells of the full screen.

It is desirable that the voltage difference between the first bias voltage Vbias1 that is the start voltage of the ramp-up waveform and the second bias voltage Vbias2 that is the start voltage of the ramp-down waveform is about 30V or less. And the gradient of the ramp-down waveform should be about 9V/μs or less in order to be able to cause an erasure discharge to the extent that the wall charges with which the address discharge can be generated to be stable can remain behind within the cell.

In the address period, the negative scan pulse SCAN is sequentially applied to the scan electrodes Y, and at the same time, the positive data pulse DATA is applied to the address electrode X. As a voltage difference between the scan pulse SCAN and the data pulse DATA is added to the wall charges generated during the initialization period, there is the address discharge generated within the cell to which the data pulse DATA is applied. There are wall charges generated within the cells selected by the address discharge.

The common sustain electrode Z is supplied with a positive DC voltage Zdc during the set-down period and the address period.

In the sustain period, the sustain pulse SUS is alternately applied to the scan electrodes Y and the common sustain electrodes Z. Then, in the cells selected by the address discharge, as the wall charges within the cell are added to the sustain pulse SUS, whenever each sustain pulse SUS is applied, a sustain discharge is generated in a surface discharge type between the scan electrode Y and the common sustain electrode Z. Lastly, after the completion of the sustain discharge, an erasure ramp waveform with a narrow pulse width is applied to the common sustain electrode Z to eliminate the wall charges within the cell.

As described above, the driving method and apparatus of the PDP according to the present invention makes it possible to reduce the initialization period by lowering the bias voltage with which the ramp-down waveform starts in consideration of the address condition of the actual panel. Further, the driving method and apparatus of the PDP according to the present invention makes it possible to improve its brightness and display quality by sufficiently assuring the sustain period affecting the brightness as much as the initialization period is reduced, as well as to stabilize the address of the cell more by initializing the cells of the full screen in use of the ramp waveform optimized to the address condition of the actual panel.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel, comprising steps of:

applying to the plasma display panel a ramp-up waveform rising from a first bias voltage; and applying to the plasma display panel a ramp-down waveform falling down from a second bias voltage subsequent to the ramp-up waveform, the second bias voltage being different than the first bias voltage, wherein a gradient of the ramp-down waveform is about 9V/μs or less.

2. The method according to claim 1, wherein the second bias voltage is lower than the first bias voltage.

3. The method according to claim 1, wherein a voltage difference between the first bias voltage and the second bias voltage is about 30V or less.

4. The method according to claim 1, wherein the ramp-up waveform and the ramp-down waveform occur within an initialization period.

5. The method according to claim 4, wherein the initialization period occurs within a first sub-field.

6. The method according to claim 5, wherein the initialization period also occurs within subsequent sub-fields.

7. The method according to claim 1, wherein the ramp-up waveform and the ramp-down waveform are applied to a scan electrode of the plasma display panel.

8. A driving apparatus of a plasma display panel, comprising:

a driving circuit applying to the plasma display panel a ramp-up waveform rising from a first bias voltage and a ramp-down waveform falling down from a second bias voltage, the second bias voltage being different than the first bias voltage, wherein a gradient of the ramp-down waveform is about 9V/μs or less.

9. The driving apparatus according to claim 8, wherein the second bias voltage is lower than the first bias voltage.

10. The driving apparatus according to claim 8, wherein a voltage difference between the first bias voltage and the second bias voltage is about 30V or less.

11. The driving apparatus according to claim 8, wherein the driving circuit applies the ramp-up waveform and the ramp-down waveform to a scan electrode of the plasma display panel.

12. The driving apparatus according to claim 11, wherein the driving circuit applies a scan voltage to the scan electrode, and then applies a sustain pulse to the scan electrode.

13. The driving apparatus according to claim 12, further comprising:

a data driving circuit for applying data to a data electrode of the plasma display panel; and a sustain driving circuit for applying the sustain pulse to a common sustain electrode of the plasma display panel.

14. A plasma display comprising:

a plasma display panel;

a plurality of scan electrodes;

a first driving circuit to apply a ramp-up waveform and a subsequent ramp-down waveform to one of the scan electrodes, the ramp-up waveform occurring from a first voltage and the ramp-down waveform occurring from a second voltage different than the first voltage, wherein a gradient of the ramp-down waveform is no more than approximately 9V/μs.

15. The plasma display according to claim 14, wherein the second voltage is lower than the first voltage.

16. The plasma display according to claim 14, wherein the first driving circuit additionally applies a scan voltage to the scan electrode, and then applies a sustain pulse to the scan electrode.

17. The plasma display according to claim 14, further comprising:

a second data driving circuit to apply data to a data electrode of the plasma display panel; and a third driving circuit to apply the sustain pulse to a common sustain electrode of the plasma display panel.

18. The plasma display according to claim 14, wherein the ramp-up waveform and the ramp-down waveform occur within an initialization period.

* * * * *